US006083348A

United States Patent [19]

Auhorn et al.

[11] Patent Number: 6,083,348

[45] Date of Patent: Jul. 4, 2000

[54] METHOD FOR PRODUCING PAPER

[75] Inventors: Werner Auhorn, Frankenthal; Dietmar Mönch; Rainer Dyllick-Brenzinger, both of Weinheim; Rainer Scholz, Dannstadt-Schauernheim; Rainer Blum, Mutterstadt; Hubert Meixner, Ludwigshafen, all of Germany

[73] Assignee: BASF Aktiengesellschaft, Ludwigshafen, Germany

[21] Appl. No.: 09/147,582

[22] PCT Filed: Dec. 9, 1997

[86] PCT No.: PCT/EP97/06857

§ 371 Date: Jan. 27, 1999

§ 102(e) Date: Jan. 27, 1999

[87] PCT Pub. No.: WO98/29603

PCT Pub. Date: Jul. 9, 1998

[30] Foreign Application Priority Data

Dec. 27, 1996 [DE] Germany ..... 196 54 390

[51] Int. Cl.[7] ..... D21H 23/04; D21H 21/00

[52] U.S. Cl. ..... 162/183; 162/185; 162/216; 162/190; 162/168.1; 162/164.6; 162/181.1

[58] Field of Search ..... 162/158, 183, 162/216, 336, 343, 184, 185, 181.1–181.7, 166, 164.6, 168.1–168.7, 190, 189

[56] References Cited

U.S. PATENT DOCUMENTS

| | | | |
|---|---|---|---|
| 3,933,966 | 1/1976 | Waris et al. | 162/183 |
| 4,897,158 | 1/1990 | Weisshuhn et al. | 162/259 |
| 4,909,904 | 3/1990 | Kinzler | 162/343 |
| 4,940,512 | 7/1990 | Hendren et al. | 162/109 |
| 5,147,509 | 9/1992 | Kuragasaki et al. | 162/343 |
| 5,149,402 | 9/1992 | Riddick | 162/336 |
| 5,196,091 | 3/1993 | Hergert | 162/258 |
| 5,560,807 | 10/1996 | Hauser | 162/183 |
| 5,688,372 | 11/1997 | Huovila et al. | 162/212 |
| 5,814,191 | 9/1998 | Houvila | 162/216 |

FOREIGN PATENT DOCUMENTS

| | | |
|---|---|---|
| 0 335 575 | 10/1989 | European Pat. Off. . |

OTHER PUBLICATIONS

W. Auhorn, et al., Wochenblatt für Papierfabrikation, vol. 13, pp. 493–502, "Untersuchung Von Storsubstanzen In Geschlossenen Kreislaufsystemen", 1979.

*Primary Examiner*—Stanley S. Silverman
*Assistant Examiner*—José A. Fortuna
*Attorney, Agent, or Firm*—Oblon, Spivak, McClelland, Maier & Neustadt, P.C.

[57] ABSTRACT

Paper is produced by draining a paper stock containing process chemicals on a paper machine, a main stream of the paper stock and a dilution stream which consists of white water, contains at least 5% by weight of the process chemicals and amounts to 5–35% by volume of the total head box feed being fed via a head box to the paper machine wire. The papers thus produced have an excellent formation profile and an outstanding ash distribution.

15 Claims, No Drawings

METHOD FOR PRODUCING PAPER

METHOD FOR PRODUCING PAPER

The present invention relates to a process for the production of paper by draining a paper stock containing process chemicals on a paper machine in which a main stream of the paper stock and a dilution stream consisting of white water and amounting to 5–35% by volume of the total head box feed are fed via a head box to the paper machine wire.

BACKGROUND OF THE INVENTION

The process described above is known in the technical literature as the module jet concept, cf. Das Papier, Number 10A (1995), pages V 99-V 105, and Wochenblatt für Papierfabrikation, 122 (1994), 485–491. With the aid of this special head box, it is possible to produce, inter alia, high-quality supercalandered papers (SC papers) having a high filler content and a uniform formation. However, the papers obtainable by this process have a tendency to dusting.

The paper machines usually have only a single stream for feeding the paper stock to the head box. In addition to the fibers suspended in water, the paper stock contains process chemicals, such as fixing agents, drainage aids, retention aids and flocculants and may contain sizes, dry and wet strength agents, dyes and fillers. The metering of the process chemicals to the paper stock can be carried out by various methods described in the literature. For example, Wochenblatt für Papierfabrikation 13 (1979), 493-502 discloses the use of cationic polyelectrolytes in combination with bentonite, first bentonite and then the cationic polyelectrolytes being added to the paper stock and it being possible, if required, to subject the paper stock to a shear gradient.

EP-B-0 235 893 discloses that a synthetic cationic polymer having a molar mass of more than 500.000 can initially be added to a paper stock, resulting in the formation of flocks which are then comminuted to microflocks in a subsequent shearing step. Thereafter, bentonite is added and the paper stock containing the process assistants is drained. In the papermaking process disclosed in EP-A-0 335 575, two different water-soluble, cationic polymers are added in succession to the paper stock. Here, a low molecular weight cationic polymer is first metered in as a fixing agent and then a high molecular weight cationic polymer as a flocculant, the paper stock is then subjected to a shear stage with the formation of microflocks, bentonite is added and the paper stock is then drained. However, the formation profile of the papers thus produced is unsatisfactory.

SUMMARY OF THE INVENTION

It is an object of the present invention to provide a process for the production of paper, an increase in the retention, in particular the fiber and crill retention and, if required, the filler retention being achieved in comparison with the known processes and at the same time papers having a uniform formation profile being obtained.

We have found that this object is achieved, according to the invention, by a process for the production of paper by draining a paper stock containing process chemicals and, if required, fillers on a paper machine in which a main stream of the paper stock and a dilution stream consisting of white water and amounting to 5–35% by volume of the total head box feed are fed via a head box to the paper machine wire, if at least 5% by weight of the process chemicals are metered into the dilution stream. The papers thus produced have a uniform formation profile and surprisingly contain a qualitatively very good bond of the crill and fillers to the long fiber, so that these papers exhibit virtually no dusting or exhibit dusting which causes no problems. Moreover, the interfering substances generally contained in the white water, such as wood ingredients or tacky impurities from the paper coat in the case of recycled fibers or with the use of waste paper, are virtually quantitatively fixed to the paper stock and thus rendered harmless for the papermaking process and the subsequent paper recycling.

DETAILED DESCRIPTION OF THE INVENTION AND THE PREFERRED EMBODIMENTS

The novel process comprises a head box having a main stream and a dilution stream which is fed via metering valves to the individual sections of the head box for establishing the consistency profile. The dilution stream consists of white water. The white water is known to contain crill and fiber fragments from the chemical pulps or mechanical pulp fibers used in papermaking. These crill fractions can usually be removed from the circulation only with difficulty. If filler-containing papers are produced, the white water contains at least twice the amount, based on fibers, of filler compared with the main stream. The amount of dilution stream consisting of the white water is, for example, from 5 to 35, preferably from 7 to 15, % by volume, based on the total head box feed. Suitable constructions for carrying out the novel process are described in the publications "Das Papier" and "Wochenblatt für Papierfabrikation" mentioned above as prior art.

Examples of suitable process chemicals are fixing agents, drainage aids, retention aids, flocculants alone, as a mixture with one another or in combination with bentonite and/or colloidal silica, dyes, engine sizes, dry strength agents and/or wet strength agents. Polymers, such as polymers containing vinylamine units can, for example, simultaneously act as fixing agents, drainage aids, retention aids and flocculants and as dry and wet strength agents. As in the known papermaking methods, the process chemicals are therefore added to the paper stock in a conventional manner and amount so that reference may be made in this respect to the known prior art for papermaking. For example, from 0.005 to 1.0% by weight, based on dry paper, of retention aids, drainage aids or flocculants is metered into the main stream. The pH of the stock suspension is, for example, from 4.5 to 9, preferably from 6 to 8. For example, cationic fixing agents are used for eliminating interfering substances which interfere with the efficiency of retention aids, wet and dry strength agents and engine sizes. Such interfering substances are, for example, ligninsulfonates or humic acids. For example, polyethyleneimines, polymers containing vinylamine units and/or poly(diallyldimethylammonium chlorides) having a molar mass $M_w$ of, in each case, from 10000 to 2000000 may be used as cationic fixing agents. It is known that polymers containing vinylamine units are prepared by homo- or copolymerization of N-vinylformamide and subsequent hydrolysis of the polymers with acids or bases, cf. EP-B-0 071 050 and EP-B-0 216 387.

For example, cationic fixing agents, cationic drainage aids, cationic retention aids and cationic flocculants alone or as a mixture with one another may be used as process chemicals. Particularly suitable retention aids and flocculants are, for example, cationic polyacrylamides having a high molar mass, for example having molar masses $M_w$ of at least 4000000.

Polymers of this type are described in EP-A-335 575 mentioned in connection with the prior art. They are commercially available. The high molecular weight cationic polyacrylamides are prepared by polymerizing acrylamide with cationic monomers. Suitable cationic monomers are, for example, the esters of ethylenically unsaturated $C_3$–$C_5$-carboxylic acids with aminoalcohols such as dimethylaminoethyl acrylate, diethylaminoethyl acrylate, dimethylaminoethyl methacrylate, diethylaminoethyl methacrylate and di-n-propylaminoethyl acrylate. Further suitable cationic monomers which can be copolymerized with acrylamide are N-vinylimidazole, N-vinylimidazoline and basic acrylamides, such as dimethylaminoethyl acrylamide. The basic monomers can be used in the form of the free bases, as salts or in quaternized form in the copolymerization. The cationic polyacrylamides contain, for example, from 5 to 40, preferably from 10 to 40 units of cationic monomers in polymerized form. The molar masses $M_w$ of the cationic polyacrylamides are at least 4000000 and are in most cases above 5000000, for example from 5000000 to 15000000.

In addition to the cationic polyacrylamides, anionic polyacrylamides, which contain, for example, acrylic acid or methacrylic acid as polymerized units, and amphoteric polyacrylamides may also be used as drainage aids, retention aids and flocculants. Cationic, nonionic, amphoteric or anionic polymers which are used as drainage aids, retention aids and flocculants exhibit improved efficiency, for example, in combination with bentonite and/or colloidal silica. This is the case in particular when a cationic fixing agent is additionally used. The prior art stated in the introduction of the description illustrates this.

For example, water-soluble polymers which are selected from polyethyleneimines, reaction products of polyethyleneimines with at least bifunctional crosslinking agents, anionic polyacrylamides, cationic polyacrylamides, amphoteric polyacrylamides, reaction products of ethyleneimine-grafted polyamidoamines with crosslinking agents having at least two functional groups, polymers containing vinylformamide units and/or vinylamine units and poly (diallyldimethylammonium halides) are also used as process assistants. The abovementioned classes of compounds are known. Polyethyleneimines are prepared, for example, by polymerizing ethyleneimine in an aqueous medium in the presence of traces of acids or acid-donating compounds. Water-soluble, amino-containing polymeric reaction products which are obtainable by reacting Michael adducts of polyalkylenepolyamines, polyamidoamines, ethyleneimine-grafted polyamidoamines and mixtures of the stated compounds and monoethylenically unsaturated carboxylic acids, salts, esters, amides or nitriles with at least bifunctional crosslinking agents are also suitable. Such reaction products are disclosed, for example, in WO-A-94/184743. In addition to halogen-containing crosslinking agents, halogen-free crosslinking agents such as glycidyl ethers of polyalkylene glycols are particularly suitable for their preparation.

A further class of polymers containing ethyleneimine units is disclosed in WO-A-94/12560. These are water-soluble, crosslinked, partially amidated polyethyleneimines which are obtainable by reacting polyethyleneimines with monobasic carboxylic acids or their esters, anhydrides, acid chlorides or amides with amide formation and reacting the amidated polyethyleneimines with crosslinking agents containing at least two functional groups.

The monobasic carboxylic acids have, for example, 1 to 28, preferably 8 to 18, carbon atoms and may contain one or more ethylenic double bonds, for example oleic acid or linolenic acid. For the preparation of these modified polyethyleneimines, the molar masses of the suitable polyethylenimines may be up to 2 million and are preferably from 1000 to 50000. The polyethyleneimines are partially amidated with monobasic carboxylic acids so that, for example, from 0.1 to 90, preferably from 1 to 50, % of the amidated nitrogen atoms are present in the polyethyleneimines as amido groups. Suitable crosslinking agents containing at least two functional double bonds are stated above. Halogen-free crosslinking agents are preferably used.

In the reaction of amino-containing compounds with crosslinking agents, for example, from 0.001 to 10, preferably from 0.01 to 3, parts by weight of at least one crosslinking agent are used per part by weight of an amino-containing compound.

Other amino-containing adducts are quaternized polyethyleneimines. For example, both homopolymers of ethyleneimine and polymers which contain, for example, grafted-on ethyleneimine are suitable for this purpose. The polyethyleneimines obtainable in this manner have a broad molar mass distribution and molar masses of, for example, from 129 to $2.10^6$, preferably from 430 to $1.10^6$.

The polyethylenemines and the quaternized polyethyleneimines may, if required, have been reacted with a crosslinking agent containing at least two functional groups. The quaternization of the polyethyleneimines can be carried out, for example, with alkyl halides, such as methyl chloride, ethyl chloride, hexyl chloride, benzyl chloride or lauryl chloride and with, for example, dimethyl sulfate. Further suitable amino-containing polymers are phosphonomethylated polyethyleneimines and alkoxylated polyethyleneimines, which are obtainable, for example, by reacting polyethyleneimine with ethylene oxide and/or propylene oxide. The phosphonomethylated and the alkoxylated polyethyleneimine may, if required, have been reacted with a crosslinking agent containing at least two functional groups. The alkoxylated polyethyleneimines contain from 1 to 100, preferably from 2 to 20, alkylene oxide units per NH group. The molar mass of the polyethyleneimines may be up to 2 million. Polyethyleneimines having molar masses of from 1000 to 50000 are preferably used for the alkoxylation. Further suitable water-soluble retention aids or fixing agents are reaction products of polyethyleneimines with diketenes, for example of polyethyleneimines having a molar mass of from 1000 to 50000 with distearyl diketone. Such products, too, may, if required, have been reacted with a crosslinking agent containing at least two functional groups.

Reaction products of ethyleneimine-grafted polyamidoamines with crosslinking agents having at least two functional groups are disclosed in DE-B-2 434 816. Examples of suitable crosslinking agents are α,ω-bis (chlorohydrin) ethers of polyalkylene oxides having from 1 to 100 alkylene oxide units. The resulting resins have a viscosity of more than 300 mPas, measured at 20° C. in 20% by weight aqueous solution. Further process chemicals for papermaking are reaction products of polyalkylenepolyamines, dimethylamine, diethylamine or ethylenediamine with epichlorohydrin or dichloroethane or other, at least bifunctional crosslinking agents. Reaction products of this type are disclosed, for example, in EP-A-0 411 400 and DE-A-2 162 567.

Preferably used drainage aids, retention aids and flocculants are water-soluble cationic polyacrylamides having an average molar mass $M_w$ of at least 500000 and/or the water-soluble reaction products which are obtainable by reacting polyamidoamines, which are grafted with ethyleneimine, with at least bifunctional crosslinking agents. A further preferred retention system consists of combinations of cationic synthetic polymers and/or cationic starch with finely divided organic or inorganic solids. Such systems are stated in the prior art described at the outset and in EP-B-0 041 056, EP-B-0 080 986 and EP-B-0 218 674. Suitable finely divided inorganic solids for this retention system are, for example, bentonite, colloidal silica, microcrystalline talc, precipitated calcium carbonate, precipitated gypsum and/or calcined clay. The amount of finely divided solids is, for example, from 0.01 to 2.0% by weight, based on dry paper. The use of the abovementioned retention systems comprising cationic synthetic retention aids and/or cationic starch in combination with bentonite, which may have been activated with an alkali or acid, or colloidal silica is particularly preferred. Bentonite and silica and the other suitable finely divided inorganic substances are preferably used in amounts of from 0.02 to 0.5% by weight, based on dry paper.

The inorganic finely divided solids have, for example, an internal surface area of from 5 to 1000 $m^2/g$ (determined according to BET with nitrogen). In addition the stated inorganic particles, finely divided organic particles may also be suitable, for example crosslinked polyacrylic acid or modified ligninsulfonate. The finely divided organic solids, too, increase the retention. Such a system is disclosed, for example, in WO-A-96/26220 for the combination of cationically modified cellulose particles with polyacrylamides. The other abovementioned retention aids and flocculants may also be combined with these cellulose particles to give an effective retention system. The particle size of the inorganic and organic solids is, for example, from 10 nm to 10 $\mu$m in the application, i.e. on introduction into the aqueous medium.

A procedure in which a cationic fixing agent in the conventional amounts is additionally used is particularly preferred.

In the novel process, all paper grades, board and cardboard can be produced, for example papers for newsprint, medium writing and printing papers, natural gravure printing papers and also light-weight base papers for coating. For example, groundwood, thermomechanical pulp (TMP), chemothermomechanical pulp (CTMP), pressure groundwood (PGW) and sulfite and sulfate pulp may be used. Chemical pulp and mechanical pulp are also suitable raw materials for the production of pulp. These substances are further processed in more or less moist form, directly without prior thickening or drying, to give paper, especially in the integrated mills. Because the impurities have not been completely removed therefrom, these fiber materials still contain substances which greatly interfere with the conventional papermaking process. In the novel process, however, pulps containing interfering substances can also be directly processed.

In the novel process, both filler-free and filler-containing papers may be produced. The filler content of paper may be up to 40, preferably from 5 to 25, % by weight. Examples of suitable fillers are clay, kaolin, natural and precipitated chalk, titanium dioxide, talc, calcium sulfate, barium sulfate, alumina, satinwhite and mixtures of the stated fillers.

The consistency of the pulp is, for example, from 0.1 to 15% by weight. For example, at least one cationic polymer is initially added to the fiber stock suspension as a fixing agent, followed by at least one cationic polymer which acts as a retention aid. This addition results in considerable flocculation of the paper stock. In at least one subsequent shearing stage, which may consist of, for example, one or more purification, mixing and pumping stages or a pulper, screen, refiner or wire, through which the preflocculated paper stock is passed, the hard giant flocks present in the flocculated system are destroyed. Preferably after the shearing stage, bentonite, colloidal silica or calcined clay is added, resulting in the formation of soft microflocks. The amounts of bentonite, colloidal silica or calcined clay are from 0.01 to 2, preferably from 0.02 to 0.5, % by weight, based on dry paper stock. Bentonite is a sheet aluminum silicate based on montmorillonite, which occurs in nature. It is generally used after replacement of the calcium ions with sodium ions. For example, bentonite is treated in aqueous suspension with sodium hydroxide solution. It thus becomes completely swellable in water and forms highly viscous thixotropic gel structures. The lamella diameter of the bentonite is, for example, from 1 to 2 $\mu$m and the lamella thickness is about 10 Å. Depending on the type and activation, the bentonite has a specific surface area of from 60 to 800 $m^2/g$. Owing to the large internal surface area and the externally negative excess charges at the surface, such inorganic polyanions can be used for overall adsorptive effects of paper stocks subjected to cationic charge reversal and shear treatment. Optimum flocculation in the paper stock is thus achieved.

Owing to the abovementioned division of the head box feed into a main stream and a dilution stream, at least 5% by weight of the process chemicals are metered into the dilution stream. In the case of retention systems comprising cationic polymers and finely divided solids, the cationic polymers can, for example, preferably be added completely to the main stream and the finely divided solids exclusively to the dilution stream consisting of white water. However, it is also possible, for example, to add from 60 to 95% by weight of this retention system to the main stream in a conventional manner and to meter the remainder of the mixture via the white water. A procedure in which an antifoam is introduced into the dilution stream has proven particularly useful.

Dyes, engine sizes (in particular alkyldiketene dispersions, rosin size, alkenylsuccinimide dispersions or polymer dispersions having a sizing action) and strength agents (for example polyamidoamine crosslinked with epichlorohydrin) may, if required, be metered into the head box exclusively via the dilution stream. Preferably, from 5 to 40% by weight of the process chemicals are introduced into the dilution stream.

Unless stated otherwise, parts and percentages are by weight. The molar masses were determined by light scattering.

EXAMPLES

Polymer 1

Using the method stated in DE-B-2 434 816, Example 3, a polyamidoamine is prepared by subjecting adipic acid to a condensation reaction with diethylenetriamine and is then grafted in aqueous solution with an amount of ethyleneimine such that the polyamidoamine contains 6.7 ethyleneimine units grafted on per basic nitrogen group. A 10% strength aqueous solution of the polymer has a viscosity of 22 mPas.

The polyamidoamine grafted with ethyleneimine is then crosslinked by reaction with a bisglycidyl ether of a polyethylene glycol having an average molar mass of 2000 according to Example 3 of DE-B-2 434 816. A polymer containing ethyleneimine units and having a viscosity of 120 mPas (determined in 10% aqueous solution at 20° C. and pH 10) is obtained. The concentration of the aqueous solution is 12.5% and the pH is 10.

Polymer 2

Cationic copolymer of acrylamide and dimethylaminoethyl acrylate, which is quaternized with methyl chloride, contains 84 mol % of acrylamide and has a molar mass of about 10 million. The charge density of the copolymer is 1.7 mEq/g at pH 4.5.

Polymer 3

Crosslinked polyethyleneimine having an average molar mass $M_w$ of 1.4 million and a charge density of 20.4 mEq/g (measured at pH 4.5).

Polymer 4

Crosslinked polyethyleneimine having an average molar mass of 1 million and a charge density of 14.7 mEq/g (measured at pH 4,5).

Example 1

A stock composition which contained 35 parts of groundwood, 17 parts of deinked waste paper, 19 parts of long-fiber sulfate pulp, 25 parts of broke and 25 parts of clay was used as a starting material for the production of SC paper (supercalandared paper). This paper stock was processed on an SC paper machine equipped with a module jet head box from Voith-Sulzer. 0.29% of polymer 1 was metered into the main stream of the paper stock upstream of the vertical screen, and 0.024% of polymer 2 downstream of the vertical screen. A dilution stream comprising white water to which 0.03%, based on dry paper, of polymer 1 was metered was fed via the module jet head box to the paper machine wire. The volume ratio of main stream to dilution stream was 9 : 1. The ash retention was 29.5%, and the fiber and crill retention was 62.4%. The paper contained the crill and fillers in qualitatively very well bound form and had a very good formation profile and an excellent ash distribution.

Comparative Example 1

Example 1 was repeated, except that the paper stock described above was fed to the SC paper machine in a single stream without module jet system, together with the stated process assistants, and was drained. The ash retention was 27.8% and the fiber and crill retention 60.3%.

Example 2

Example 1 was repeated, with the sole exception that now 0.38% of polymer 4, instead of polymer 1, was metered into the dilution stream. The ash retention was 33.6% and the fiber and crill retention 63.6%. The paper has an excellent uniform formation profile.

Example 3

A stock composition comprising 40 parts of groundwood, 40 parts of bleached pine sulfate pulp, and 20 parts of coated broke was processed to paper on a paper machine for wood-containing base papers for coating. The paper machine was equipped with a dilution head box from Valmet. With the aid of this apparatus, a dilution stream consisting of white water was fed to the head box. The ratio of main stream to dilution stream was 9 : 1. 0.05%, based on dry paper, of polymer 2 was metered into the main stream upstream of the vertical screen. 0.03%, based on dry paper, of polymer 3 and 0.1%, likewise based on dry polymer, of bentonite were metered into the dilution stream, in each case upstream of the vertical screen. The ash retention was 30.5% and the fiber and crill retention 69.5%. The paper had a uniform formation profile.

Comparative Example 2

Example 3 was then repeated without the dilution head box. The ash retention was 26.8% and the fiber and crill retention 64.6%.

Example 4

Example 3 was repeated, except that 0.02% of polymer 2 was metered into the dilution stream of the dilution head box, upstream of the vertical screen, and 0.1% of bentonite downstream of the vertical screen, and 0.04% of polymer 2 was added to the main stream before passage through the vertical screen, the percentages in each case being based on dry paper. The ash retention was 30.1% and the fiber and crill retention 69.7%. The paper had an excellent ash distribution and a uniform formation profile.

Comparative Example 3

Example 4 was repeated without dilution head box metering. The ash retention was 25.7% and the fiber and crill retention 63.7%.

We claim:

1. A process for the production of paper by draining a paper stock containing process chemicals on a paper machine in which a head box feed divided into a main stream of the paper stock and a dilution stream consisting of white water are fed via a head box to the paper machine wire, said dilution stream amounting to 5–35% by volume of the total head box feed, and wherein at least 5% by weight of the process chemicals are metered into said dilution stream.

2. A process as claimed in claim 1, wherein the process chemicals used are fixing agents, drainage aids, retention aids, flocculants alone, as a mixture with one another or in combination with bentonite or colloidal silica, dyes, engine sizes, dye strength agents or wet strength agents.

3. A process as claimed in claim 1, wherein the process chemicals used are cationic fixing agents, cationic drainage aids, cationic retention aid and cationic flocculants alone or as a mixture with one another.

4. A process as claimed in claim 1, wherein cationic or anionic polymers which act as drainage aids, retention aids and flocculants are used in combination with bentonite or colloid silica.

5. A process as claimed in claim 4, wherein a cationic fixing agent is additionally used.

6. A process as claimed in claim 1, wherein the process chemicals used are water-soluble polymers which are selected from polyethyleneimines, reaction products of polyethyleneimines with at least bifunctional crosslinking agents, anionic polyacrylamides, cationic polyacrylamides, amphoteric polyacrylamides, reaction products of ethyleneiminegrafted polyamidoamines with crosslinking agents having at least two functional groups, polymers containing vinylformamide units or vinylamine units and poly (diallyldimethylammonium halides).

7. A process as claimed in claim 1, wherein the cationic fixing agents used are polyethyleneimines, polymers containing vinylamine units or poly(diallyldimethylammonium chlorides) having a molecular mas $M_w$ of in each case from 10.000 to 2 million.

8. A process as claimed in claims 1, wherein the drainage aids, retention aids and flocculants used are watersoluble cationic polyacrylamides having an average molar mass $M_w$ of at least 500.000 or the water-soluble reaction products which are obtainable by reacting polyamidoamines, which are grafted with ethyleneimine, with at least bifunctional crosslinking agents.

9. A process as claimed in claim 1, wherein the process chemicals used are combinations of cationic polymers or cationic starch with finely divided organic or inorganic solids.

10. A process as claimed in claim 9, wherein the finely divided inorganic filler used is bentonite, colloidal silica, microcrystalline talc, precipitated calcium carbonate, precipitated gypsum or calcined clay.

11. A process as claimed in claim 1, wherein the amount of finely divided solids is from 0.01 to 2.0% by weight, based on dry paper.

12. A process as claimed in claim 1, wherein the paper stock contains at least one filler.

13. A process as claimed in claim 1, wherein said dilution stream amounts to 7–15% by volume of the total head box feed.

14. A process as claimed in claim 1, wherein said dilution stream amounts to about 10% by volume of the total head box feed.

15. A process as claimed in claim 1, wherein 5 to 40% by weight of the process chemicals are metered into the dilution stream.

* * * * *